United States Patent [19]

Milner et al.

[11] Patent Number: 4,589,138

[45] Date of Patent: May 13, 1986

[54] METHOD AND APPARATUS FOR VOICE EMULATION

[75] Inventors: Ronald E. Milner, Grass Valley; Nolan K. Bushnell, Woodside, both of Calif.

[73] Assignee: Axlon, Incorporated, Sunnyvale, Calif.

[21] Appl. No.: 725,953

[22] Filed: Apr. 22, 1985

[51] Int. Cl.[4] ..... A63H 3/33

[52] U.S. Cl. ..... 381/110; 381/51

[58] Field of Search ..... 381/110, 46, 53, 120, 381/123, 122; 446/175, 297; 367/198; 360/90; 434/185

[56] References Cited

U.S. PATENT DOCUMENTS

| | | | |
|---|---|---|---|
| 2,527,145 | 10/1950 | Mitchell . | |
| 3,165,595 | 1/1965 | Noshiro | 360/90 |
| 3,469,039 | 9/1969 | Lee | 360/8 |
| 4,052,564 | 10/1977 | Propst et al. | 179/15 M |
| 4,107,462 | 8/1978 | Asija | 381/110 |
| 4,221,927 | 9/1980 | Dankman et al. . | |
| 4,278,838 | 7/1981 | Antonov | 381/52 |
| 4,470,150 | 9/1984 | Ostrowski | 381/52 |
| 4,516,950 | 5/1985 | Berman et al. | 446/297 |

FOREIGN PATENT DOCUMENTS 965827 8/1964 United Kingdom .

*Primary Examiner*—James L. Dwyer

*Attorney, Agent, or Firm*—Townsend and Townsend

[57] ABSTRACT

A voice emulation device, operation of which is initiated by a person's voice, is disclosed. The device includes detector circuitry that responds to a voice to produce a binary indication of the voice that is delayed by a serial shift register. The delayed binary indication is coupled to a digital-to-analog converter where the rising and falling edges of the binary indication are "shaved" to provide the delayed binary indication with attack and decay characteristics to form an amplitude envelope. The amplitude envelope is modulated by a modulation signal of a pseudo-randomly varying (audio) frequency to generate an output signal which, when converted to aural form, produces a pseudo-articulate sound (i.e., voice emulation).

19 Claims, 8 Drawing Figures

METHOD AND APPARATUS FOR VOICE EMULATION

The present invention is directed to a voice-actuated, pseudo-articulate sound emulation device, and finds particular applicability in children's toys such as dolls and stuffed animals.

BACKGROUND OF THE INVENTION

Recent attempts at making children's toys more realistic include providing the toys with a variety of sound-producing devices to emulate a sound normally associated with that toy. For example, toy aircraft, land vehicles, and the like would be equipped to produce engine-like sound; in a similar fashion, dolls and stuffed animals are sometimes provided some form of "squeaker," or a small phonograph playback device that voices a small library vocabulary upon the push of a button, pull of a string, etc.

All such sound emulation toys, however, have for the most part one common characteristic: The toy must usually be manually manipulated to activate the sound emulation device; thus, the toy must be pressed, poked, or repositioned in some way for sound actuation. Further, when voice is desired, only a very small repertoire can be provided, otherwise the cost of the toy cannot be kept within reasonable limits.

There are, of course, computer-based voice synthesis apparatus—some operable in response to voice actuation. However, such apparatus is usually too expensive, precluding their use in a child's toy.

SUMMARY OF THE INVENTION

Accordingly, disclosed here is a method, capable of implementation by an expensive and relatively simple apparatus, for producing pseudo-articulate (voice-mimicking) sounds in response to being spoken to by a child.

The present invention broadly includes a method of forming an amplitude envelope signal from a delayed digital pulse in response to detection of a child's (or other person's) voice. Rising and falling edges of the pulse are shaped to simulate attack and decay portions of the amplitude envelope. The amplitude envelope is frequency-modulated by a modulation signal whose frequency varies within the audio range in a pseudo-random manner to produce, when applied to a speaker, a pseudo-articulate sound.

The preferred embodiment of the device of this invention is implemented in apparatus that includes a preamplifier/detector circuit that produces a binary signal indicative of detection of the presence of a person's voice. A multi-stage serial shift register receives and functions to delay this binary signal, applying the delayed version to a form of a digital-to-analog converter to produce the amplitude envelope. A frequency generator including a voltage-controlled oscillator responsive to voltage derived from the output of a polynomial counter, produces clock signals having pseudo-randomly varying frequencies. One of these clock signals is used as the modulation signal that modulates the amplitude envelope, producing therefrom an audio signal of varying pitch or tone. When applied to an electromechanical conversion device (i.e., speaker), the pseudo-articulate (albeit unintelligible) sound is produced.

In an alternate embodiment of the invention a microprocessor is operable in response to the binary signal produced by the preamplifier/detector circuit to practice the method of the present invention.

The present invention provides a number of advantages not heretofore realized. First, when used in a child's toy or other amusement device, the present invention obviates the need of manual manipulation of the toy or device in order to activate its sound-producing operation. The apparatus of the present invention responds to voice actuation without need for any poking, punching or movement.

In addition, the invention does not respond immediately because of the delay feature; a response is produced from detection of a person's voice a short period later.

The invention does not attempt to produce a response that mimics the actuating voice. To the contrary, the randomly varying audio frequency content of the sound produced by the invention simulates a response to, rather than a mimicking of, the actuating voice. Thereby, the invention can provide a toy or other device with a "personality."

These and other features and advantages of the present invention will become apparent to those skilled in the art upon a reading of the following detailed description of the invention, which should be taken in conjunction with the accompanying drawings.

DETAILED DESCRIPTION OF THE INVENTION

A. Overview

Figure 1:
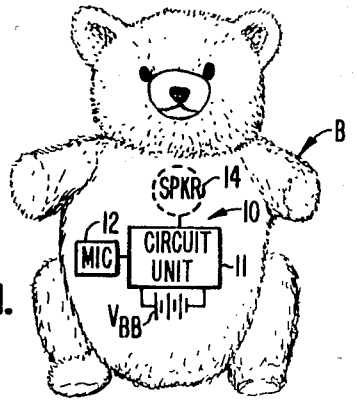
FIG. 1 is a simplified block diagram of the present invention.

The present invention, as indicated, is a voice emulation device that is activated by and responds to a person's voice with pseudo-articulate sound; i.e., it emulates talk, albeit rather inarticulate talk, that responds to, for example, the voice of a child. Preferably, the device forms part of a child's toy, such as, for example, a stuffed animal. Thus, as illustrated in FIG. 1, a voice emulation device, designated generally with the reference numeral 10, is implanted in and forms a part of a stuffed bear B. As shown, the voice emulation device 10 includes a microphone 12 and speaker unit 14. A battery $V_{BB}$ supplies a DC voltage for the circuit unit 11.

When a child (or adult, for that matter) speaks, the sound waves are picked up by the microphone 12, converted to electrical impulses, and applied to the circuit unit 11. The circuit unit, after a short predetermined delay, produces an electrical audio signal that is applied to the speaker 14 and converted to sound heard by the child. As will be seen the sound produced by the voice emulation device 10 produces a sound having a pitch that varies in a pseudo-random fashion. The voice emulation device 10 is capable of also modulating the loudness of the sound produced, providing short bursts (approximately two seconds or less), each having an attack and a decay portion. The length of each burst is dictated, in the main, by the activating voice, but as indicated, is limited to no longer than approximately two seconds. If the activating voice is less than two seconds, the sound produced by the voice emulation device 10 will also be less than two seconds.

Figure 1A:
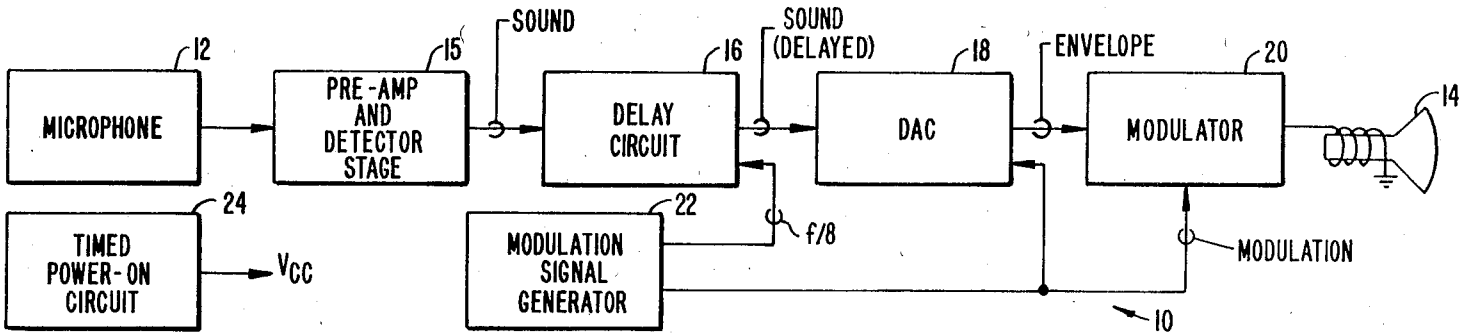
FIG. 1A is a detailed block diagram of the invention of FIG. 1.

FIG. 1A illustrates, in a more detailed block diagram form, the sound emulation device 10.

As shown, a microphone 12 produces an electrical signal in response to audio sounds received by it, and couples these electrical signals to a preamplifier/detector stage 15. The preamplifier/detector stage 15 produces a binary SOUND signal, indicative of a received and detected voice, that is delayed by a delay circuit 16, in the form of a multi-stage, serial shift register. The output of the delay circuit 16 is transformed to an analog equivalent by a digital-to-analog converter (DAC) 18 to produce an ENVELOPE signal. As will be seen more clearly below, the digital-to-analog conversion process is performed in a manner that smooths and "stretches" edges of the delayed version of the SOUND signal, forming an ENVELOPE with attack and decay portions.

The ENVELOPE signal produced by the DAC 18 is applied to a modulator 20. Also applied to modulator 20 is a MODULATION signal produced by frequency generator 22. The frequency generator 22 is constructed to produce the MODULATION SIGNAL in the form of a binary waveform whose frequency continuously varies in the audio spectrum in a pseudo-random manner. The output of the modulator 20, therefore, is an audio signal with a pitch that continuously and randomly varies, and with an amplitude that corresponds to that of the AMPLITUDE signal.

The modulation signal generator 22 also provides the clock signals necessary for operation of the delay circuit 16 (which receives the clock signal f/8) and the DAC 18 (which receives as a clock signal the MODULATION signal).

The sound emulation apparatus 10 operates generally by monitoring the sound received at the microphone module 10—which converts received sound to an electrical signal and applies it to the preamplifier/detector stage 15. If the detected sound is of a sufficient level, thereby allowing discrimination of ambient or background noise, the SOUND signal is produced, and applied to the delay circuit 16. After approximately a two-second delay, the delayed version of the SOUND signal appears at the output of the delay circuit 16 and is applied to DAC 18, forming the ENVELOPE signal.

Applied to the modulator 20, the ENVELOPE signal is modulated by the MODULATION signal, producing an audio output of a randomly varying frequency having an amplitude corresponding to the ENVELOPE signal. The audio output is then applied to an audio output transducer or speaker 14, and converted to a pseudo-articulate sound that varies in both pitch and loudness as the modulation signal and ENVELOPE, respectively, vary. The sound thereby produced, albeit unintelligible, is a voice-like emulation having a pitch and energy content that is different from that of the voice that activates the sound emulation device 10—yet somewhat similar in pattern.

To enhance the charm of the toy (stuffed bear B), the sound emulation apparatus 10 is provided with circuitry that simulates a "snooze" state if the bear B has not been spoken to for a short period. This circuitry. It includes a timed power-on circuit 24 that provides the DC power ($V_{CC}$) for operation of the rest of the circuitry. As will be seen with reference to FIG. 4, and its accompanying discussion, the timed power-on circuit 24 is capable of terminating communication of $V_{CC}$ when the sound emulation device 10 is left motionless for a predetermined period of time (approximately two minutes). The toy (stuffed bear B—FIG. 1) with which the invention is used will not respond to a person's voice, and appears to have dozed off. "Awakening" of the sound emulation apparatus 10 is effected when it is moved; an alternate aspect of this feature provides for "awakening" when a person's voice is detected.

B. Detailed Discussion

1. Producing the ENVELOPE

Figure 2:
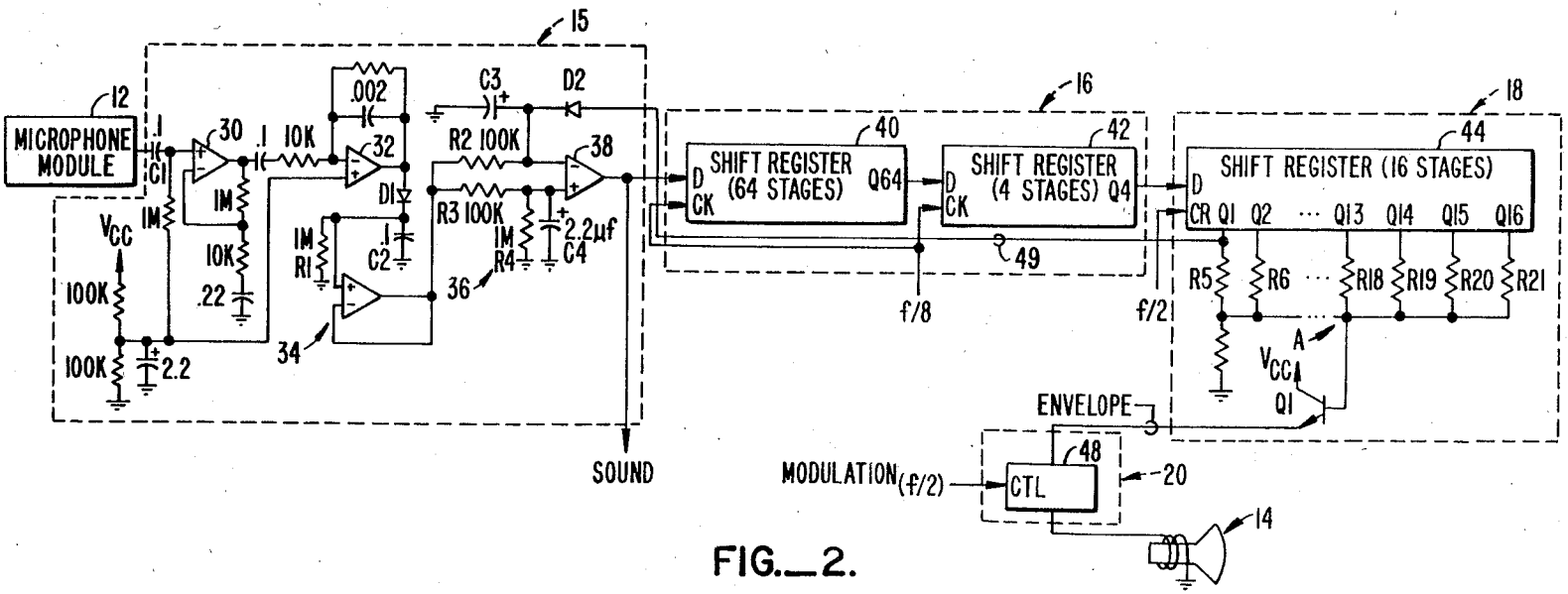
FIG. 2 is a schematic diagram of the circuitry used to form the amplitude envelope, including the preamplifier and detector stages, the delay circuit, the digital-to-analog converter, and the modulator stages of FIG. 1A.

Referring now to FIG. 2, the preamplifier/detector stage 15, delay circuit 16, DAC 18 and modulator 20 are illustrated in greater detail.

As shown, the signal produced by the microphone module 12 is coupled to a preamplifier circuit comprising amplifiers 30 and 32, and associated circuitry, by a coupling capacitor C1. The received signal is amplified and applied to a detector circuit comprising diode D1 and the parallel configuration of capacitor C2 and resistor R1. The detector functions to provide a DC voltage that is indicative of the audio level of the signal from microhone module 12. The DC voltage is applied, via a voltage follower 34, to an energy detect circuit 36 comprising comparator 38, and input resistors R2, R3, respectively connected to the inverting (−) and non-inverting (+) inputs of comparator 38. The energy detect circuit 36 functions to produce a binary signal, one state of which, a logic HIGH, forms the SOUND signal.

The inverting input to comparator 38 receives an average DC voltage level from the preamplifier and detector stages. The non-inverting input receives slightly less than the average DC voltage received at the inverting input by reason of the voltage divider formed by the resistors R3 and R4. At quiescence, comparator 38 sees a slightly higher DC voltage at its inverting input than at its non-inverting input. The output of comparator 38, therefore, will be a LOW.

When the microphone module picks up a person's voice, the DC voltage from the voltage follower 34 changes. By reason of the difference in time constants in the circuitry that couples the DC voltage level to the inputs of comparator 38, the non-inverting (fast) input experiences the voltage change much faster than the inverting input. Thus, an increase in the voltage level produced by the voltage follower 34 will be seen at non-inverting input of comparator 38 before it affects the average level at the inverting input due to capacitor C3. This increase will cause the comparator 38 to change to a HIGH, resulting in the SOUND signal.

Thus, the electrical signals from the microphone 12 are amplified by amplifiers 30 and 32 and applied to the detector circuit of diode D1, resistor R1 and capacitor C2. A voltage level is formed corresponding to the audio frequency content of the received signal and applied to amplifier 38. If a predetermined average level, as determined by the response times set by the circuitry at the inputs of comparator 38, and the voltage divider network of resistors R3/R4, is not exceeded, the output of amplifier 38 remains a logic ZERO. On the other hand, if the average level is exceeded, the output of amplifier switches to a logic ONE to create the SOUND signal, applying it to the delay circuit 16.

The pre-amplifier and detector stage 15 serves to detect speech against a relatively constant background noise, producing the SOUND signal that goes HIGH and LOW in a manner that follows the speech pattern of the detected voice.

The output of the energy detect circuit 36, the SOUND signal, is coupled to the delay circuit 16. The delay circuit 16 comprises two serial shift registers—a 64-stage shift register 40 and a 4-stage serial shift register 42 connected to form a 68-stage shift serial shift register. Both shift registers 40 and 42 are synchronously clocked by the clock signal f/8, received at their respective clock (CK) inputs. The clock signal f/8 is generated by the frequency generator 22 (FIGS. 1 and 4) which will be discussed further hereinafter.

When the delayed version of the SOUND signal reaches the last stage output Q4 of shift register 42 it is coupled to the data (D) input of a 16-stage serial shift register 44, which forms a part of the DAC 18. Shift register 44 has the outputs Q1–Q12 of the first twelve stages each connected to a voltage node A by a corresponding one of equally weighted (10K ohms) resistors R5–R17; the remaining four stages Q18–Q21 are connected to the voltage node A by resistors R18–R21, the values of which are 20K, 20K, 30K and 30K ohms, respectively, for reasons that will be explained below. Summing node A, in turn, is connected to the base lead of an amplifier transistor Q1, the emitter lead of which forms the output stage of DAC 18 whereat the ENVELOPE signal is produced.

The emitter lead of the transistor Q1 is connected to the input of a single-pole, single-throw solid-state switch 48 of the modulator 20. A clock signal f/2 is received at the select (SEL) input of the solid-stage switch 48, operating to alternately communicate the ENVELOPE signal and an open (i.e., a high impedance state) to the speaker 14 at the frequency of f/2.

The SOUND signal is clocked into the combined serial shift registers 40 and 42 at a clock rate of f/8 (approximately a 50 Hz clock frequency). Approximately one and one-half seconds later the delayed version of the SOUND signal will reach the first stage of the shift register 44. As this delayed version of the SOUND signal is clocked through the sixteen stages of the shift register 44 the voltage level at summing node A experiences a step-wise increase with each clock pulse of the f/2 clock.

2. Waveforms

Figure 3:
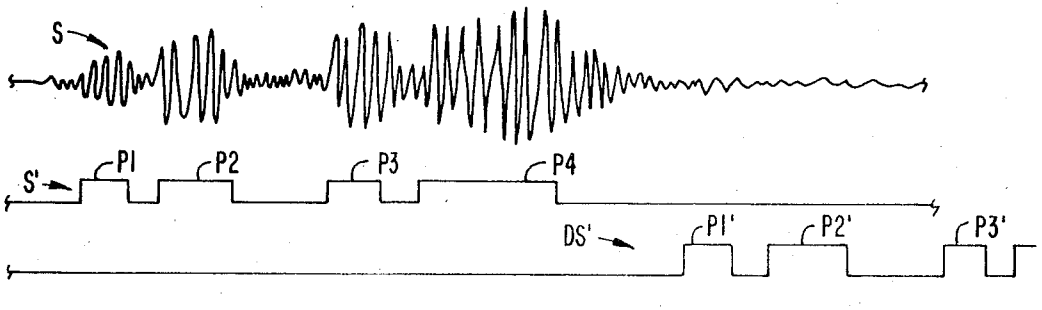
FIGS. 3 and 3A are illustrations of the wave-forms encountered in use of the invention.
Figure 3A:
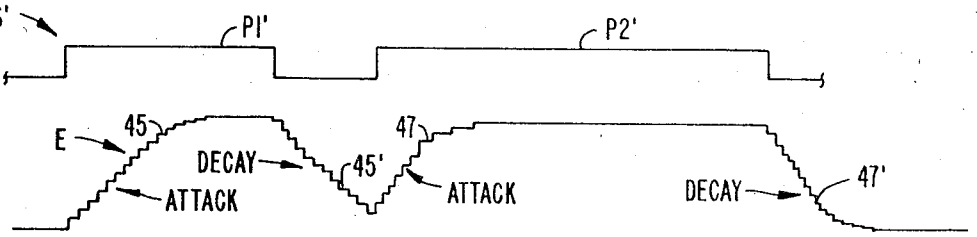

The initiation and formation of the ENVELOPE signal is illustrated in FIGS. 3 and 3A. A speech signal S is produced by the microphone 12 and processed by the preamplifier and detector stage to become the SOUND waveform S'. Note the pulses P1–P4 of the SOUND waveform S' which correspond generally to the envelope pattern of the speech signal S.

The delayed version of the SOUND waveform S is illustrated as waveform DS' in FIG. 3. FIG. 3A shows the delayed pulses P1' and P2' in greater detail. As the pulses P1' and P2' of waveform DS' are shifted into and through the stages of shift register 44, the ENVELOPE waveform E will be produced having the attack (rising) and decay (decreasing) portions illustrated. In particular, note the rounded parts 45 and 47 of the attack portions of the ENVELOPE waveform which are developed by the uneven weighting of the resistors R18–R21. In similar fashion, the rounded parts 45' and 47' of the decay portions are also produced. As noted above, the ENVELOPE waveform dictates the amplitude of the sound produced by speaker 14.

The waveform of the SOUND signal, and therefore, the ENVELOPE signal, is dictated by the detected voice that activates the apparatus. While the time for any part of the SOUND signal to appear at the final output Q16 of shift register 44 is approximately one and one-half seconds, most voice actuation will create a pattern of SOUND signals smaller than this one and one-half second interval. To ensure that the apparatus does not respond to itself, output Q1 of the shift register 44 is used as a feedback signal and coupled back via signal line 49 and diode D2 to the inverting input of amplifier 38. When the device "speaks" this path will cause the average level signal (at the inverting input of comparator 38) to suddenly increase, effectively keeping the comparator 38 from creating SOUND signals until capacitor C3 discharges approximately two seconds.

3. Modulation Signal Generator

Figure 4:
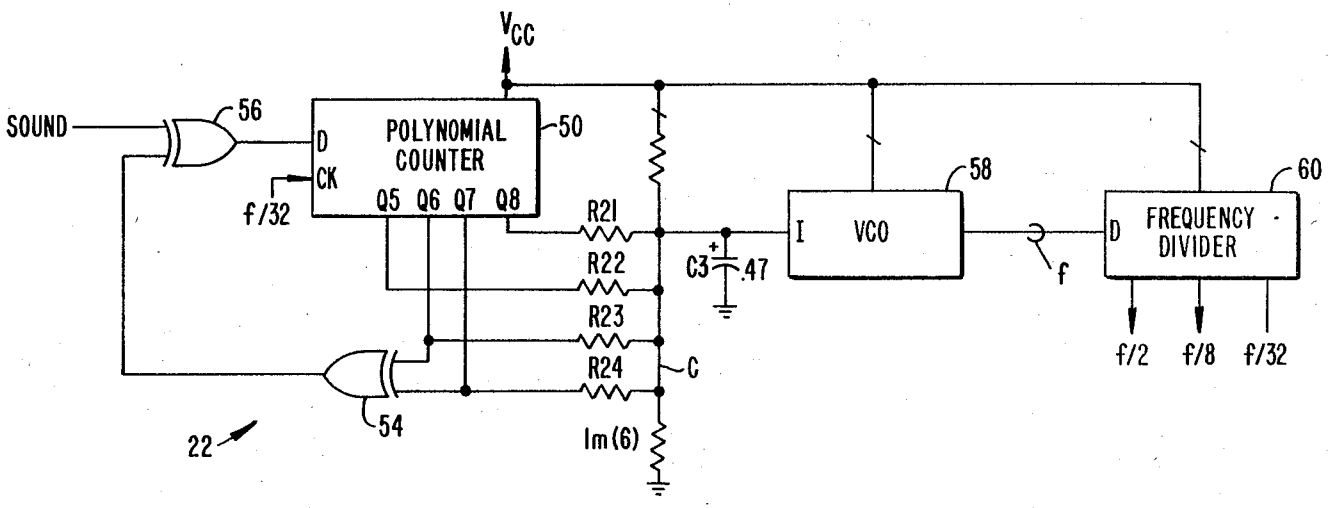
FIG. 4 is a schematic diagram of the clock generator that produces the pseudo-randomly varying clocks used by the invention of FIG. 1.
Figure 5:
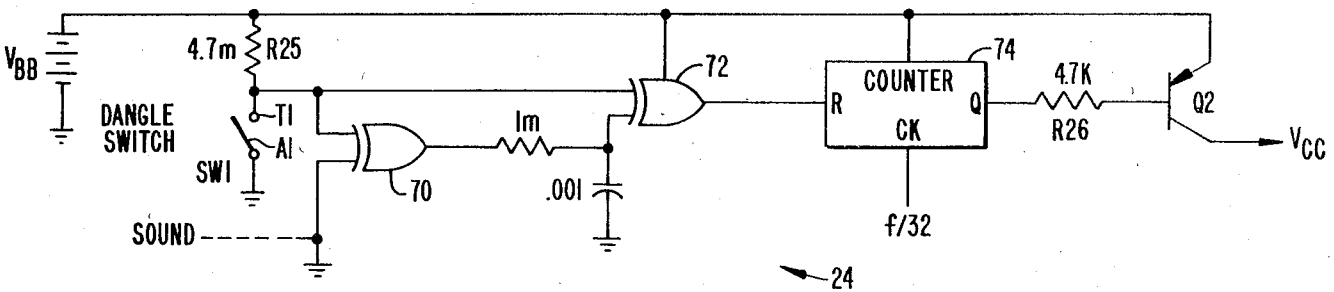
FIG. 5 is a diagram of a timed power-on circuit used to supply DC voltage to the circuitry implementing the present invention, and illustrating a "sleep" mode of operation.

All clock signals are produced by the modulator signal generator 22, a more detailed diagram of which is illustrated in FIG. 4. As shown, the modulation signal generator 22 includes a 7-stage serial shift register 50 configured as a maximal length polynomial counter by a feedback loop consisting of a pair of two-input EXCLUSIVE-OR gates 54 and 56. Preferably, two stages of the shift register 50 are selected for feedback via EXCLUSIVE-OR gate 54 so that the counter obtains a maximum count of $2^N-1$, where N is the number of counter stages, i.e., 7. Accordingly, the outputs Q6 and Q7 of the sixth and seventh stages of the shift register 50 are applied to the two inputs of the EXCLUSIVE-OR gate 54.

The output of the EXCLUSIVE-OR gate 54 is connected to one of the two inputs of EXCLUSIVE-OR gate 56; the other input receives the SOUND signal from the amplifier 38 (FIG. 2). This allows the counter to recover from the all-ZEROs state. The shift register 50 receives the output of EXCLUSIVE-OR gate 56 at its data (D) input, and receives a clock signal f/32 at its clock (CK) input.

The last four outputs Q5, Q6, Q7 and Q8, of the shift register 50 are each coupled to a voltage node C by resistors R21–R24. The voltage created at the voltage node C is a pseudo-randomly varying voltage that is smoothed by the capacitor C3 and applied to the input I of a voltage-controlled oscillator (VCO) 58.

The VCO 58 produces, in response to the pseudo-randomly varying voltage produced by the polynomial counter at voltage node B, an output signal f having a frequency that also pseudo-randomly varies. The output signal f from the VCO 58 is applied to a 5-stage frequency divider 60. The first, third and fifth stages of the frequency divider 60 produce clock signals f/2, f/8 and f/32 which are respectively divisions by 2, 8, and 32 of the output signal f. As the output signal f varies, the three clock signals f/2, f/8 and f/32 also vary—in a pseudo-random fashion.

As hereinabove noted in connection with the discussion of FIG. 2, the clock signals f/2 is applied to the solid-stage switch 44 while the clock signal f/8, a submultiple of clock signal f/2, is applied to the shift register 44 (FIG. 2). In this manner, pseudo-random variations in delay of the SOUND signal, (2) the attack and decay portions of the resultant ENVELOPE signal, the time out of the SOUND signal, and the modulation frequency are produced. These variations all combine to produce an audio signal with varying pitch, amplitude (i.e., loudness) and a voice-actuated response with a life-like effect.

4. Timed Power-On Circuit

The circuitry of the invention may be powered directly by a small battery. However, as an alternate aspect of the invention there is provided a "snooze" feature in the form of the timed power-on circuit 24, shown in greater detail in FIG. 4. As illustrated, the timed power-on circuit 24 includes a battery $V_{BB}$, a pair of EXCLUSIVE-OR gates 70 and 72, a binary counter 74, and a PNP pass transistor Q1 which provides, at its collector lead, supply voltage $V_{CC}$. The battery $V_{BB}$ is connected to one of the two inputs of the EXCLUSIVE-OR gate 70 through a resistance R25; that input is also connected to a terminal T1 of a "dangle" switch SW1. Dangle switch SW1 is of the type having a switch arm A1 that makes intermittent contact with the terminal T1 whenever the apparatus is moved or shaken. The switch arm A1 of the dangle switch SW1 is connected to a ground potential. The second input of the EXCLUSIVE-OR gate 70 is also connected to ground potential although, as indicated by the dotted line, it could alternatively be connected to receive the SOUND signal.

The output of the EXCLUSIVE-OR gate 70 is coupled, by a resistor/capacitor delay network, to one of two inputs of the EXCLUSIVE-OR gate 72; the other input of the EXCLUSIVE-OR gate 72 is connected to the terminal T1 of dangle switch SW1. The output of the EXCLUSIVE-OR gate 72 connects to the reset (R) input of the binary counter 74.

Binary counter 74 is clocked by the clock signal f/32, which is received at its clock (CK). An output Q of binary counter 74, taken from the last stage of the counter, connects to the base lead of the transistor Q1 by a current-limiting resistor R27.

The timed power-on circuit 24 operates as follows: The switch arm A1 of the dangle switch SW1 may either be in contact with the terminal T1 or out of contact with the terminal. Assume that the arm A1 is as shown, not in contact with terminal T1, and that this condition has been in existence for a long period of time (i.e., longer than approximately two–three minutes). Accordingly, both inputs to EXCLUSIVE-OR gate 72 are provided with logic HIGHs, and its output is a logic LOW, the logic state required at the R input of the binary counter 74 for counting operation. This discussion assumes the timed power-on circuit 24 has previously timed-out, leaving the counter 74 in a current state with output Q in a HIGH state, turning off Q2, and deactivating all the rest of the circuitry, including clock f/32. When, however, the timed power-on circuit 24 is moved or shaken, the switch arm A1 of the dangle switch SW1 will contact the terminal T1, shorting resistor R25 to ground and causing a logic ZERO to appear at the inputs of EXCLUSIVE-OR gate 72. In turn, the output of the EXCLUSIVE-OR gate 72 will go HIGH momentarily until the output (HIGH) produced by the EXCLUSIVE-OR gate 70 is passed by the delay network coupling that output to the input of EXCLUSIVE-OR gate 72. The binary counter 74 is thereby reset to a zero state, placing the output Q at a logic ZERO. This places the transistor Q1 in conduction, causing $V_{CC}$ to rise from approximately zero volts to approximately the voltage of $V_{BB}$. Appearance of the supply voltage $V_{CC}$ activates the circuitry of the invention.

The binary counter 74 begins counting in response to the clock signal f/32 until, approximately two minutes later, the count reaches a point at which the Q output goes HIGH. This terminates conduction of the transistor Q2 and the supply voltage $V_{CC}$ is brought to near-zero volts, disabling the circuitry of the invention. The frequency generator 22, which receives $V_{CC}$, ceases operation and clock f/32 stops. Binary counter 74 remains in this state, with output Q HIGH, and the apparatus is now in a "sleep" or "snooze" state until the apparatus is again moved.

In the example set forth above, switch arm A1 was assumed out of contact with the terminal T1. It will be evident to those skilled in the art, from a review of FIG. 4, that the opposite could have been true; the switch arm A1 could have been initially in contact with the terminal T1 of the dangle switch S1 and had been that way for some time. It will be seen that under this condition, the R input of the binary counter 74 sees a logic ZERO. When the switch arm A1 breaks its contact with the terminal T1 the R input to the binary counter 74 experiences a momentary HIGH, again resetting the counter to its ZERO state and ultimately bringing $V_{CC}$ into existence by placing transistor Q2 in conduction.

When used in a child's toy, the timed power-on circuit 24 has particular application in obtaining two distinct advantages: First, it provides a further aspect of realism for the child by simulating a sleeping state of the toy; a toy that periodically dozes off and must be shaken awake. Second, it will certainly be appreciated that the timed power-on circuit 24 conserves the charge storage of the battery $V_{BB}$.

In summary, there has been disclosed a pseudo-articulate sound-producing device that responds to voice. Realism is provided with a minimum of circuit components by providing a modulation signal generator 22 capable of producing a number of clock signals with a pseudo-random varying frequency. By using various of these pseudo-randomly varying clock signals to (1) delay response, (2) form attack and decay portions of an envelope signal, and (3) modulate that amplitude envelope the apparatus produces sound, in response to an actuating voice, that has its own personality.

Figure 6:
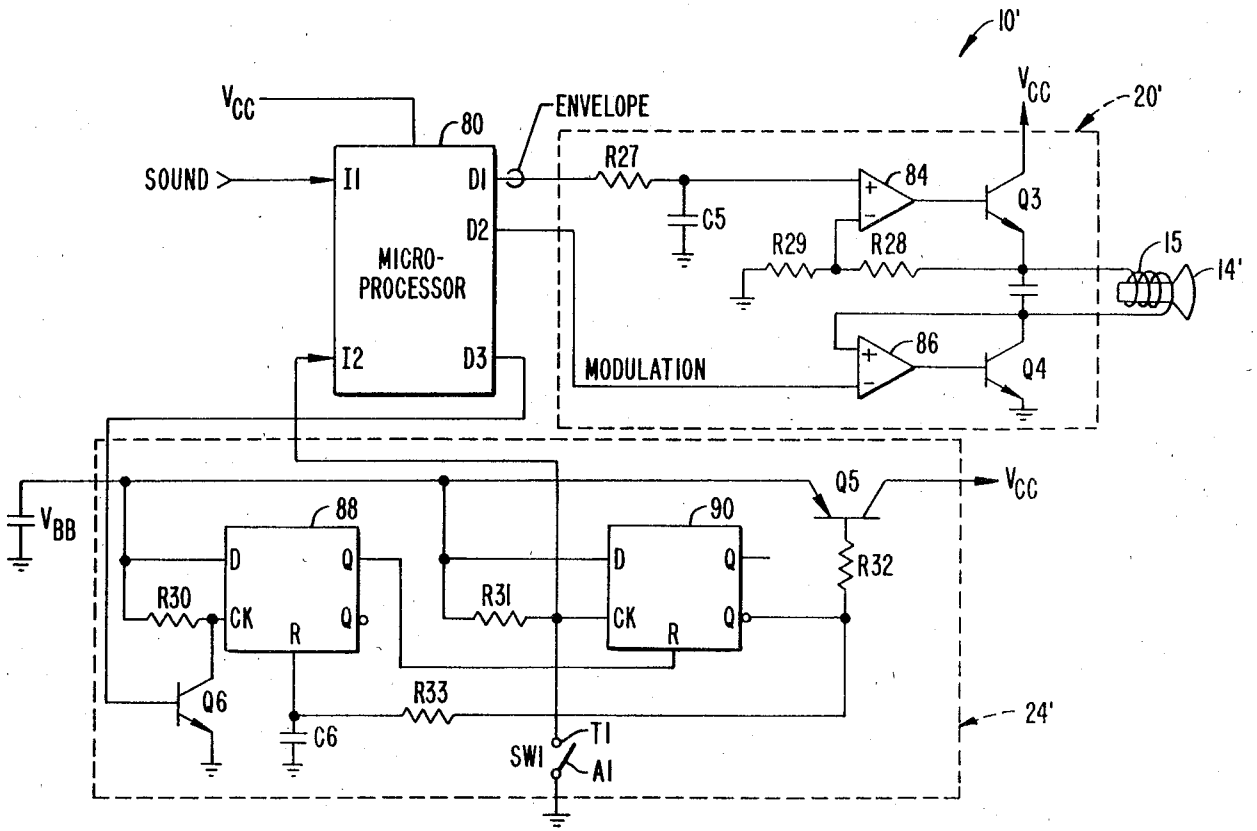
FIG. 6 is an illustration of an alternate embodiment of the invention, using a microprocessor.

Illustrated in FIG. 6 is an alternate embodiment of the invention that utilizes a microprocessor to perform the operations necessary to forming the output audio. In this embodiment, the microphone 12 and preamplifier/detector stage 15 remain unchanged and, accordingly, are not depicted in FIG. 6 for reasons of clarity. As FIG. 6 shows, the alternate embodiment, designated generally in FIG. 6 with the reference numeral 10', includes a microprocessor 80 that receives at an input I1 the SOUND signal generated by the preamplifier/detector stage 15 (FIGS. 1A and 2). The microprocessor 80 is coupled, from two of its data outputs D1 and D2, to a modulator 20', comprising an integrating network of resistor/capacitor R27/C5, amplifiers 84 and 86, and drive transistors Q3 and Q4. The microprocessor 80 provides, at its data output D1, the ENVELOPE signal. The initial and trailing portions of the ENVELOPE signal are pulses having an increasing duty cycle, a form of pulsewidth modulation, so that, when applied to the integrating R27/C5, the attack and decay portions are formed. The output of the R27/C5 network is coupled to the non-inverting input of amplifier 84 which, in turn, is coupled to the base lead of the drive transistor Q3. The emitter lead of the transistor Q3 connects to one of two terminals of the speaker unit 14'. Resistors R28 and R29 set the gain of the amplifier 84.

At its output D2 the microprocessor 80 produces the MODULATION signal, and, similar to the preferred embodiment of the invention (FIGS. 1-5), the MODULATION signal produced by the microprocessor 80 is a pulse train with a pseudo-randomly varying pulse reoccurrence frequency. The output D2 of the microprocessor 80 is connected to the inverting input of the amplifier 86. The output of the amplifier 86 connects to the base lead of the drive transistor Q4 whose collector connects to the other of the two terminals of speaker 14'.

The microprocessor 80 continually samples the state of the signal received at its input I1 to, in effect, store a bit pattern in an internal memory (not shown) indicative of the sampled SOUND signal. Subsequently (approximately two seconds after any particular sample), each bit pattern representing the SOUND signal appears at the output D1 of the microprocessor 80. In effect, this function of sampling the SOUND signal for reproduction at the output D1 is substantially identical to that performed by the shift registers 40 and 42 that make up the delay circuit 16 (FIGS. 1 and 2). The signal produced by the microprocessor 80 at its output D1 is integrated (i.e., smoothed) by the integrating network R27/C5, forming the attack portion of the ENVELOPE signal, similar to that illustrated in FIG. 3A, and coupled to the speaker winding 15 of the speaker 14'.

At the same time, at the data output D2, the microprocessor produces a pseudo-randomly varying square-wave signal that is also coupled to the winding 15 of the speaker 14' via the amplifier 26 and the drive transistor Q4. The resultant sound is produced by the speaker 14'.

The timed power-on circuit also changes in this alternate embodiment, and is shown in FIG. 6, designated with the reference numeral 24'. The counting operation formed by the counter 74 (FIG. 5) is now incorporated in the microprocessor 80. The timed power-on circuit 24' contains the circuitry necessary to react to operation of the dangle switch SW1 and to shut down to a "sleep" state after a predetermined period of time of operation.

The timed power-on circuit 24' of the alternate embodiment is shown as including a pair of FLIPFLOPS 88 and 90. The data (D) inputs of the FLIPFLOPS 88 and 90 are coupled to the battery $V_{BB}$, while the clock (CK) inputs are also coupled to the battery $V_{BB}$ via resistors R30 and R31, respectively. A data output (D3) of the microprocessor 80 is coupled to the clock (CK) input of the FLIPFLOP 88 by the transistor Q6. The Q output of the FLIPFLOP 88 is connected to the reset (R) input of the FLIPFLOP 90, and the $\overline{Q}$ output of the FLIPFLOP 90 is connected to the reset (R) of the FLIPFLOP 88 via a RC delay network comprising resistors R33 and capacitor C6. The $\overline{Q}$ output of FLIPFLOP 90 is also connected to the base lead of a pass transistor Q5 via a base resistance R32.

The major portion of the electronics of the voice emulation device 10' is without the supply voltage ($V_{CC}$) if the toy in which the device 10' is placed has not been moved for a relatively long period of time. In this state, the $\overline{Q}$ output of FLIPFLOP 90 is HIGH, placing the pass transistor Q5 in a non-conducting state. Assume, for the moment, that the toy embodying the voice emulation device 10' is moved so that the swing arm A1 of the dangle switch SW1 momentarily breaks contact the terminal T1. The voltage at the clock (CK) input of the FLIPFLOP 90 momentarily goes HIGH, causing the (previously HIGH) output $\overline{Q}$ to go LOW and placing the transistor Q5 in conduction. Thereby, the electronics of the voice emulation device 10' become operable with the appearance of the supply voltage $V_{CC}$ at the collector terminal of transistor Q4. The microprocessor 80 then responds to any SOUND signals produced by the preamplifier and detector stage 15 to produce an ENVELOPE signal and a MODULATION signal as required. After a predetermined time (approximately one and one-half to two minutes—which time is reset by any change in data at the microprocessor input I2), microprocessor 80 will generate a LOW signal at its D3 output to turn off the transistor Q6 and allow the voltage at the clock (CK) input of the FLIPFLOP 88 to go HIGH. In turn, the Q output of the FLIPFLOP 88 goes HIGH, resetting the FLIPFLOP 90, causing the $\overline{Q}$ output to go HIGH. The transistor Q5 is turned off, terminating the supply voltage $V_{CC}$. The electronics (except for the FLIPFLOPS 88, 90) are placed in a "sleep" state until the next time the switch arm A1 breaks contact with the terminal T1 of the dangle switch SW1.

It will be appreciated, by those skilled in this art, that the invention described herein is capable of modification. For example, the particular circuitry used to implement the preamplifier and detector stage 14 could have been done by using an automatic gain control followed by a fixed threshold circuit. Other modifications can obviously be made without departing from the scope and spirit of this invention.

We claim:

1. A voice-actuated pseudo-articulate sound generator, comprising:

sound responsive detector means for producing an electrical signal having an amplitude envelope indicative of an actuating voice;

delay means coupled to the detector means for delaying said electrical signal having said amplitude envelope for a predetermined period of time;

frequency generator means for providing a modulation signal having a randomly varying frequency;

means coupled to receive the delayed electrical signal having said amplitude envelope and the modulation signal to produce an audio output signal having an amplitude corresponding to that of the delayed electrical signal and a pitch corresponding to the modulation signal; and means for transforming the audio output signal to sound having an amplitude envelope corresponding to said amplitude envelope of the activating voice.

2. The sound generator of claim 1, wherein said electrical signal having said amplitude envelope is a binary signal having one state indicative of presence of the voice.

3. The sound generator of claim 2, wherein the delay means includes a multi-stage serial shift register for receiving said electrical signal and serially shifting said electrical signal therethrough.

4. The sound generator of claim 3, including digital-to-analog converting means coupled to the serial shift register to receive the delayed electrical signal and to form attack and decay portions thereof.

5. The sound generator of claim 1, wherein the delay means includes a digital-to-analog converter, the delayed electrical signal having attack and decay portions formed thereon by the digital-to-analog converter.

6. The sound generator of claim 5, wherein the delay means includes a multi-stage serial shift register for receiving the electrical signal having said amplitude envelope and serial shifting the electrical signal therethough to an output stage of the multi-stage shift register.

7. The sound generator of claim 6, wherein the digital-to-analog converter includes a plurality of resistors each coupling a corresponding output of the terminal stages to a voltage summing node.

8. The sound generator of claim 1, wherein the frequency generator means includes means for generating a randomly varying clock signal, and wherein the delay means includes a multi-stage shift register coupled to receive the clock signal and the electrical signal so that the electrical signal having said amplitude envelope is serially shifted to an output of the shift register in response to the clock signal.

9. The sound generator of claim 1, including means for inhibiting the electrical signal a predetermined time after its appearance.

10. The sound generator of claim 1, including means for placing the sound generator in a state of low power consumption.

11. The sound generator of claim 1, the frequency generator means including a polynomial counter, second digital-to-analog converting means responsive to the polynomial counter for producing a randomly varying voltage, and a voltage controlled oscillator responsive to the varying voltage to produce the modulation signal.

12. A method of producing pseudo-articulate sound in response to a person's voice, comprising the steps of:

providing a binary signal having an amplitude envelope indicative of the person's voice;

delaying the binary signal while preserving said amplitude envelope;

providing said delayed binary signal having said amplitude envelope with an attack portion at the leading edge thereof and a delay portion at the trailing edge thereof;

modulating the delayed binary signal with said attack and decay portions with a modulation signal having an audio frequency.

13. The method of claim 12, wherein the binary signal is a single-bit, two-state signal having one state indicative of the presence of a person's voice.

14. The method of claim 12, including the step of providing the modulation signal with a pseudo-randomly varying frequency.

15. Electronic pseudo-articulate sound producing apparatus, comprising:

means for producing a binary signal from sound having an amplitude envelope corresponding to said sound;

means coupled to receive the binary signal and add an attack portion to the leading edge thereof and a decay portion to the trailing edge thereof;

means for modulating the binary signal having attack and decay portions with a pseudo-randomly varying frequency to produce therefrom an output signal having a pseudo-randomly varying frequency content; and means coupled to receive and convert the output signal to sound.

16. The apparatus of claim 15, including means for producing the pseudo-randomly varying frequency, comprising:

means for producing a pseudo-randomly varying voltage;

a voltage-controlled oscillator coupled to receive the pseudo-randomly varying voltage to produce therefrom a pseudo-randomly varying clock signal.

17. A child's toy comprising in combination: a stuffed animate object;

means for producing a binary signal from sound having an amplitude envelope corresponding to said sound;

means coupled to receive and delay the binary signal and add an attack portion to the leading edge thereof and a decay portion to the trailing edge thereof of said binary signal;

means for modulating the delayed binary signal having an attack and decay portions with pseudo random varying frequency to produce therefrom an output signal having a pseudorandom varying frequency content;

means to couple to receive and convert the output signal to sound;

means for placing the apparatus in a low power consuming state upon non-physical movement of the animate object and means for removing the apparatus from the low power consuming state upon physical movement of the animate object.

18. The apparatus of claim 17, including supply means for providing electrical power to the apparatus, the supply means including timer means operably coupled to reduce the electrical power provided to the apparatus after a predetermined period of operation.

19. The apparatus of claim 17, the supply means including means operable in response to physical movement of the apparatus to reset the timer means and restore the electrical power to the apparatus.

* * * * *